United States Patent [19]

Kuchii

[11] Patent Number: 4,709,189

[45] Date of Patent: Nov. 24, 1987

[54] TRANSISTOR INVERTER DEVICE FOR FLUORESCENT LAMP

[76] Inventor: Toshiyuki Kuchii, 109-8, Ishikawa-cho 3-chome, Naka-ku, Yokohama-shi, Kanagawa-ken, Japan

[21] Appl. No.: 673,731

[22] Filed: Jan. 24, 1985

[51] Int. Cl.[4] ..... H05B 37/02

[52] U.S. Cl. ..... 315/209 R; 375/DIG. 7

[58] Field of Search ..... 315/209 R, 226, DIG. 2, 315/DIG. 7; 363/24, 134

[56] References Cited

U.S. PATENT DOCUMENTS

| | | | |
|---|---|---|---|
| 3,667,027 | 5/1972 | Martin | 363/134 X |
| 4,351,020 | 9/1982 | Leti et al. | 363/134 X |
| 4,373,146 | 2/1983 | Bonazoli et al. | 315/DIG. 7 X |
| 4,454,574 | 6/1984 | Bush et al. | 363/134 |
| 4,535,271 | 8/1985 | Holmes | 315/DIG. 7 X |
| 4,553,039 | 11/1985 | Stifter | 363/134 X |
| 4,553,070 | 11/1985 | Sairanen et al. | 315/209 R |

*Primary Examiner*—David K. Moore

*Attorney, Agent, or Firm*—Hill, Van Santen, Steadman & Simpson

[57] ABSTRACT

A transistor inverter circuit which has high efficiency and low power consumption for a fluorescent lamp including an oscillator formed as an integrated circuit which generates a square wave and an input transformer which has two base windings that generate square waves having opposite polarities with one of the base windings connected to the oscillator and receiving the square wave from the oscillator and a switching circuit that has two transistors connected in tandem with one of the transistors having one of the base windings connected between its base and its emitter and the other transistor having the other base winding connected between its base and its emitter such that one of the transistors is turned on and the other is turned off during a half cycle of the square wave generated in the base windings. A fluorescent lamp is connected between the junctions of the two transistors and electrical charging capacitors and a resistor and a capacitor is connected in series between the integrated circuit oscillator and the switching circuit so as to cause smooth switching.

1 Claim, 1 Drawing Figure

K
R11
R12
C12
C13
C11
L
D
C
A
B
CH1
D5
D6
Q1
Q2
C
B
E
R8
R7
C9
C10
R9
R10
N3
N1
N2
T
C8
R6
IC3
IC4
C5
D7
R50
R5
VCC
IC2
C7
ZD
R2
C4
C6
BE
R4
R3
B0
A
SW
R1
B
D2
D1
D4
D3
C3
C2
L2
C1
FS
S
L1

TRANSISTOR INVERTER DEVICE FOR FLUORESCENT LAMP

BACKGROUND OF THE INVENTION

This invention relates to a transistor inverter device for a fluorescent lamp.

A conventional transistor inverter has been a DC/AC inverter constructed by a combination of an oscillating transformer and two transistors connected in a push-pull format, which forms a self-excited oscillator. Since the AC voltage generated by the self-excited oscillator is taken out from secondary windings of the oscillating transformer and then supplied to a load, there is a considerable power loss resulting in a decrease of power efficiency.

SUMMARY OF THE INVENTION

It is, therefore, an object of the invention to provide a transistor inverter device for a fluorescent lamp which utilizes, instead of a self-excited DC/AC oscillator, a separately excited oscillator comprising two transistors connected in tandem with the transistors being alternately turned on and off to supply power to a load decreasing power loss.

According to the invention, there is provided a transistor inverter device for a fluorescent lamp which comprises an oscillator constructed as an integrated circuit and generating a square wave, a switching circuit including two transistors connected in tandem, one of the transistors being turned on and the other turned off in a half cycle of the square wave, and said one of transistors being turned off and said other turned on in a next half cycle of the square wave. In response to the square wave from the oscillator, a fluorescent lamp which is connected at its one terminal to a junction between the two transistors, and electron charge capacitors connected to the other end of the fluorescent lamp is turned on.

BRIEF DESCRIPTION OF THE DRAWING

These and other objects of the invention will be seen by reference to the description, taken in connection with the accompanying drawing, in which.

DESCRIPTION OF THE PREFERRED EMBODIMENT

Figure 1:
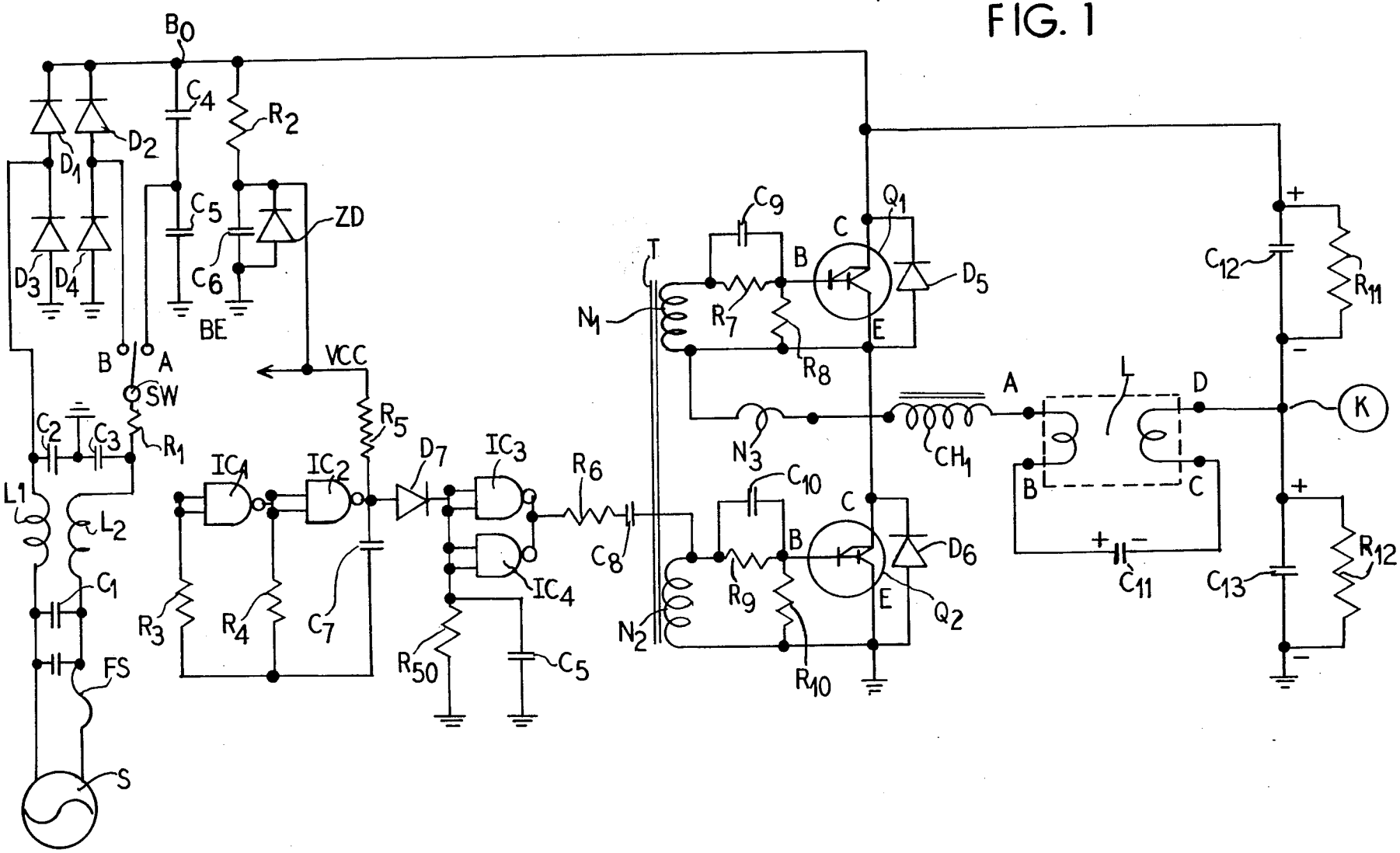
FIG. 1 is a circuit for showing a transistor inverter device for a fluorescent lamp according to the invention.

In the figure, a power source S supplies AC 100 or 200 V (volts). Connected to the power source S is a noise filter which comprises a fuse FS, capacitors $C_1$, $C_2$ and $C_3$, and inductance coils $L_1$ and $L_2$. A bridge rectifier circuit which comprises four diodes $D_1$, $D_2$, $D_3$ and $D_4$ is provided. One of output terminals of the noise filter is connected to one of the input terminals of the bridge rectifier circuit while the other output terminal of the noise filter is connected to the other input terminal of the bridge rectifier circuit through a resistor $R_1$ and a switch SW. The switch SW has two contacts A and B. The contact B of the switch SW is connected to the aforementioned other input terminal of the bridge rectifier circuit and the contact A of the switch SW is connected to a junction between capacitors $C_4$ and $C_5$ which form a smoothing circuit. When AC 200 V is used as power source, the switch SW is moved over to its contact B. In such a case, the AC 200 V is full-wave rectified by the bridge rectifier circuit to obtain DC 280 V at Bo point. It should be noted that the capacitors $C_4$ and $C_5$ form a smoothing circuit. On the other hand, when AC 100 V is used as power source, the switch SW is moved over to its contact A, the AC 100 V is rectified by a voltage doubler rectifier circuit which comprises the capacitors $C_4$ $C_5$ and the diodes $D_2$ and $D_4$, and DC 280 V is also obtained.

The DC 280 V thus obtained is used to supply power to a fluorescent lamp, which will be described hereinafter, and is also used to generate 12 V for an IC (integrated circuit) power source through a resistor $R_2$ for a voltage drop and a stabilizing zener diode ZD. It should be noted that a capacitor $C_5$ is used for smoothing. An oscillator according to the invention will be described. The oscillator comprises two NAND gates $IC_1$ and $IC_2$ composed of C-MOS IC, resistors $R_3$ and $R_4$ and a capacitor $C_7$. The resistor $R_3$ is used for stability of operation, and the resistor $R_4$ and the capacitor $C_7$ determine a time constant. The values of the resistor $R_3$ and capacitor $C_7$ are varied to obtain any desired oscillation frequency. In the invention, it is preferable that a frequency within a range of 12 KHz to 20 KHz is selected. Thus, a square wave, an oscillation frequency of which is within a range of 12 KHz to 20 KHz, is obtained by the oscillator which utilizes C-MOS elements as its main parts.

The oscillation frequency thus obtained is supplied through parallel connected NAND gates $IC_3$ and $IC_4$ of C-MOS IC, a resistor $R_6$ and a capacitor $C_8$ to a switching circuit for driving a fluorescent lamp, which will be described hereinafter. The NAND gates $IC_3$ and $IC_4$ form a NOT circuit. Furthermore, a resistor $R_5$, a diode $D_7$, a resistor $R_5$ and a capacitor are provided between the oscillator and the NAND gates $IC_3$ and $IC_4$ for shaping a waveform.

The aforementioned resistor $R_6$ and capacitor $C_8$ are used to prevent the occurance of troubles between an input transformer, described hereinafter, and oscillation and to make a smooth switching between transistors $Q_1$ and $Q_2$, described hereinafter.

More particularly, when the resistor $R_6$ and capacitor $C_8$ are used, a steep overshoot is generated at the rise time of the square wave and a steep overshoot is also generated at a negative side or fall time of the square wave. The steep overshoot at the negative side gives a reverse bias to the transistor which has been conductive and thereby causes smooth switching of the transistors $Q_1$ and $Q_2$.

A switching circuit according to the invention will be described. An input transformer T is provided with two base windings $N_1$ and $N_2$ which are wound together, with one or two turns of winding $N_3$ for magnetic saturation. The base windings $N_1$ and $N_2$ are wound so that they generate voltages having the same amplitude but are of opposite polarities.

The base winding $N_1$ is connected at its one end to the base of the transistor $Q_1$ through a capacitor $C_9$ and a resistor $R_7$ which are connected in parallel, and the other end is connected to the emitter of the transistor $Q_1$. A resistor $R_8$ is connected between the base and emitter of the transistor $Q_1$ and a protection diode $D_5$ is connected between the collector and emitter of the transistor $Q_1$. It is preferable that the transistor $Q_1$ be constructed as two transistor elements in a Darlington connection. The aforementioned DC 280 V is connected to the collector of the transistor $Q_1$.

Similarly, connected to transistor $Q_2$ which is also preferably constructed of two transistors in Darlington connection are a capacitor $C_{10}$, resistors $R_9$ and $R_{10}$, and a diode $D_6$.

The emitter of the transistor $Q_1$ is connected to the collector of the transistor $Q_2$ and the emitter of the transistor $Q_2$ is grounded to the earth.

A combination of the aforementioned capacitor $C_9$ and resistors $R_7$ and $R_8$, and another combination of capacitor $C_{10}$ and resistors $R_9$ and $R_{10}$ function to shape waveforms supplied to the bases of the transistors $Q_1$ and $Q_2$, respectively.

With the above-mentioned construction of the switching circuit, when a positive voltage appears on the base winding $N_1$, the transistor $Q_1$ turns on, while at that time a negative voltage appears on the base winding $N_2$ and therefore the transistor turns off, and vice versa.

The other end of the base winding $N_1$ is connected to a fluorescent lamp L (more particularly a terminal thereof) through the winding $N_3$ and a choke $CH_1$. A capacitor $C_{11}$ is connected between terminals B and C of the fluorescent lamp L, and the terminal D is connected to a junction between capacitors $C_{12}$ and $C_{13}$. The capacitors $C_{12}$ and $C_{13}$ are connected to resistors $R_{11}$ and $R_{12}$ in parallel, respectively, which function to protect the capacitors $C_{12}$ and $C_{13}$.

The operation of the transistor inverter device for fluorescent lamp according to the invention will be described.

When the power supply turns on, the DC 280 V which is supplied to the switching circuit is generated at the point $B_0$, and at the same time the oscillator generates a square wave. The square wave is transmitted to the switching circuit through the NAND gates $IC_3$ and $IC_4$, the resistor $R_6$ and the capacitor $C_8$. Assuming that, during a positive pulse of the square wave, a positive voltage appears on the base winding $N_1$, the transistor $Q_1$ turns on, while a negative voltage appears on the base winding $N_2$, and therefore the transistor $Q_2$ turns off. Consequently, for DC 280 V, a current flows through the transistor $Q_1$ from the collector to the emitter, and is then supplied through the winding $N_3$ and the choke $CH_1$ to the fluorescent lamp L. The current further flows to the junction between the capacitors $C_{12}$ and $C_{13}$. As a result, an electric charge is stored in the capacitors $C_{11}$, $C_{12}$ and $C_{13}$, as shown in the figure.

In the next half cycle of the square wave, that is, when a positive voltage appears on the base winding $N_2$ and a negative voltage appears on the base winding $N_1$, the transistor $Q_2$ turns on and the transistor $Q_1$ turns off. Consequently, the electric charge stored in the capacitors $C_{11}$, $C_{12}$ and $C_{13}$ is discharged through the choke $CH_1$, the winding $N_3$ and the transistor $Q_2$ to earth.

In the above-mentioned manner, the transistors $Q_1$ and $Q_2$ switch on and off during each half cycle of the square wave.

In the above-mentioned construction, since the invention does not utilize the self-excited oscillator and instead utilizes a separately excited oscillator composed of a C-MOS IC, which has very little power loss, to turn the switching circuit on and off, the whole power consumption is considerably lower as compared with a conventional construction.

What is claimed is:

1. A transistor inverter device having high efficiency and low power consumption for a fluorescent lamp which comprises: an oscillator constructed as an integrated circuit which generates a square wave; an input transformer which has two base windings generating opposite polarities of the square waves, one of the base windings connected to the oscillator and receiving the square wave from said oscillator; a switching circuit including two transistors connected in tandem with one of the transistors having one of the base windings connected between its base and its emitter and the other transistor having the other base winding connected between its base and its emitter so that one of the transistors is turned on and the other is turned off during a half cycle of the square wave in response to opposite polarities of the square waves generated in the base windings; a fluoresent lamp connected with one terminal to the junction between the two transistors; and electrical charging capacitors connected to the other terminal of the fluorescent lamp so as to provide an inverter device having high efficiency and low power requirements, and and further including a resistor and a capacitor connected in series and connected between the integrated circuit oscillator and the switching circuit to cause smooth switching of the switching circuit.

* * * * *